US005143017A

United States Patent [19]

Haneda et al.

[11] Patent Number: 5,143,017

[45] Date of Patent: Sep. 1, 1992

[54] DEVELOPING DEVICE HAVING A BAFFLE PLATE BETWEEN PLURAL AUGERS WHICH CLEANS THE DEVELOPING ROLLERS

[75] Inventors: Satoshi Haneda; Masakazu Fukuchi; Shizuo Morita; Shunji Matsuo, all of Tokyo, Japan

[73] Assignee: Konica Corporation, Japan

[21] Appl. No.: 645,586

[22] Filed: Jan. 24, 1991

[30] Foreign Application Priority Data

Jan. 29, 1990 [JP] Japan ..... 2-8033[U]

[51] Int. Cl.[5] ..... G03G 15/09

[52] U.S. Cl. ..... 118/658; 118/653; 355/245; 355/251; 355/260

[58] Field of Search ..... 355/245, 251, 253, 260; 226/DIG. 1; 118/653, 656, 657, 658

[56] References Cited

U.S. PATENT DOCUMENTS

| | | | |
|---|---|---|---|
| 4,162,842 | 7/1979 | Wu | 118/653 X |
| 4,435,065 | 3/1984 | Wada | 118/653 X |
| 4,481,903 | 11/1984 | Habehauer et al. | 118/653 |
| 4,498,755 | 2/1985 | Ohkubo et al. | 118/658 X |
| 4,996,565 | 2/1991 | Herley | 355/245 |

FOREIGN PATENT DOCUMENTS

| | | |
|---|---|---|
| 129355 | 12/1984 | European Pat. Off. . |
| 352102 | 1/1990 | European Pat. Off. . |
| 427499 | 5/1991 | European Pat. Off. . |

OTHER PUBLICATIONS

Patent Abstracts of Japan, vol. 8, No. 237 (P-310) (1674); Oct. 30, 1984 JPA-59-113467; Jun. 6, 1984.

Patent Abstracts of Japan, vol. 13, No. 200 (P-869) (3548); May 12, 1989 JPA-1-21472; Jul. 16, 1987.

*Primary Examiner*—A. T. Grimley
*Assistant Examiner*—J. E. Barlow, Jr.
*Attorney, Agent, or Firm*—Jordan B. Bierman

[57] ABSTRACT

A developing apparatus having a developing roll including therein a developing sleeve and a magnet roll to be faced to an image retainer for developing an electrostatic latent image on the image retainer with a developer. A partition plate is provided between developer agitating members disposed below the developing roll. A developer removing device for removing the developer on the developing sleeve is provided on an upper portion of the partition plate.

10 Claims, 3 Drawing Sheets

DEVELOPING DEVICE HAVING A BAFFLE PLATE BETWEEN PLURAL AUGERS WHICH CLEANS THE DEVELOPING ROLLERS

BACKGROUND OF THE INVENTION

1. Field of the Invention

The present invention relates to a developing apparatus for use in an electrophotographic recording apparatus, and more particularly relates to a developing apparatus disposed below an image retainer for developing an electrostatic latent image on the image retainer.

2. Description of the Prior Art

In a recording apparatus such as an electrophotographic reproducing machine, an electrostatic latent image is formed on a drum-shaped or belt-shaped image retainer, and the latent image is developed with one-component or two-component developer. In a developing apparatus, a developing roll consisting of a magnet roll having a plurality of magnets and a developing sleeve rotating around the outer peripheral surface of said magnet roll is faced to the image retainer so that a predetermined distance is maintained between the image retainer and the developing sleeve to form a developing region. The latent image on the image retainer is developed with a developer carried on the developing sleeve by applying a developing bias voltage on the developing sleeve.

Normally, in the developing apparatus, the developing roll is disposed on one side of the drum-shaped or belt-shaped image retainer. By such arrangement, it is possible to dispose a transfer means below the image retainer to transfer a toner image developed by the developing apparatus on a recording paper. If such developing apparatus is disposed on one side of the image retainer, however, the developing roll is projected laterally from a body case of the developing apparatus. Accordingly, when the developing apparatus is installed as a unit in the recording apparatus or removed therefrom, developer attached to the developing sleeve may be dropped, so that the recording apparatus may be soiled. However, if the developing roll of the developing apparatus is disposed below the image retainer, the developer does not soil the recording apparatus when the developing apparatus is installed in or removed from the recording apparatus as a unit, because the developing roll faces upwards. It has been proved that the possibility of fog or soil due to the developer in such developing apparatus with the developing roll faced upwards is smaller than that in the other type developing apparatus. The present invention relates to a developing apparatus having a developing roll faced upwards.

In case that a multi-color image is to be obtained, a plurality of developing apparatuses are arranged on a peripheral surface portion of the drum-shaped or belt-shaped image retainer. The total length of the peripheral surface of the drum-shaped or belt-shaped image retainer can be shortened by reducing the length of the peripheral surface occupied by one developing apparatus, in order to increase the recording speed and to minimize the size of the developing apparatus.

In the developing apparatus of reduced width having the developing sleeve faced upwards, a reservoir portion of the developer is provided below the developing roll consisting of the outer developing sleeve and a plurality of inner magnets, and a plurality of rotary agitating screws are disposed in said reservoir portion to circulate and agitate the developer.

A developer layer thickness regulating means for limiting the layer thickness of the developer fed to the developing sleeve is provided on the marginal peripheral surface of the rotary developing sleeve at the upstream side of the developing region. A developer removing means formed of a metallic resilient thin plate or rubber blade etc. is provided on the peripheral surface of the rotary developing sleeve at the downstream side of the developing region to remove from the developing sleeve the developer having been used for the development.

FIG. 3(*a*) is a plan view of the reservoir portion of the developer in the developing device having the developing roll faced upwards, and FIG. 3(*b*) is a section along the line A—A of FIG. 3(*a*).

In said reservoir portion, agitating screws 35*a*, 35*b* each having a blade wound herically around the screw are rotated in opposite directions, respectively, by gears 39*a*, 39*b* meshed with each other to agitate the developer. In order to agitate and circulate the developer effectively, it is preferable to provide a partition plate 36 of a height as shown by a double dot-and-dash line between the screws 35*a*, 35*b* so that the developer is agitated and circulated in directions of arrows shown in FIGS. 3(*a*) and 3(*b*). Reference numeral 30 denotes a toner supply port for supplying a toner to the developer which has been used for development.

In said developing apparatus having the developing roll faced upwards, the developer removing means and the partition plate 36 are arranged closely and accordingly it is very difficult to hold them.

SUMMARY OF THE INVENTION

An object of the present invention is to provide a developing apparatus which can solve the above problem.

In order to attain the above object, the present invention provides a developing apparatus comprising a developing roll having a developing sleeve and a magnet roll installed in said developing sleeve to be faced to an image retainer, a plurality of developer agitating members disposed below the developing roll, a partition plate provided between said developer agitating members, and developer removing means for removing developer on said developing sleeve which is provided integrally on an upper portion of said partition plate.

A hole through which the developer can be passed is provided on said partition plate.

The other objects and features of the present invention will become apparent from the following description taken with reference to the accompanying drawings.

BRIEF DESCRIPTION OF THE DRAWINGS

FIG. 1(*b*) is a sectional side view of the developing apparatus shown in FIG. 1(*a*);

FIG. 2(*b*) is a sectional view of other embodiment of the partition plate;

FIG. 3(*b*) is a sectional view of the reservoir portion shown in FIG. 3(*a*).

DESCRIPTION OF THE PREFERRED EMBODIMENTS

Figure 1A:
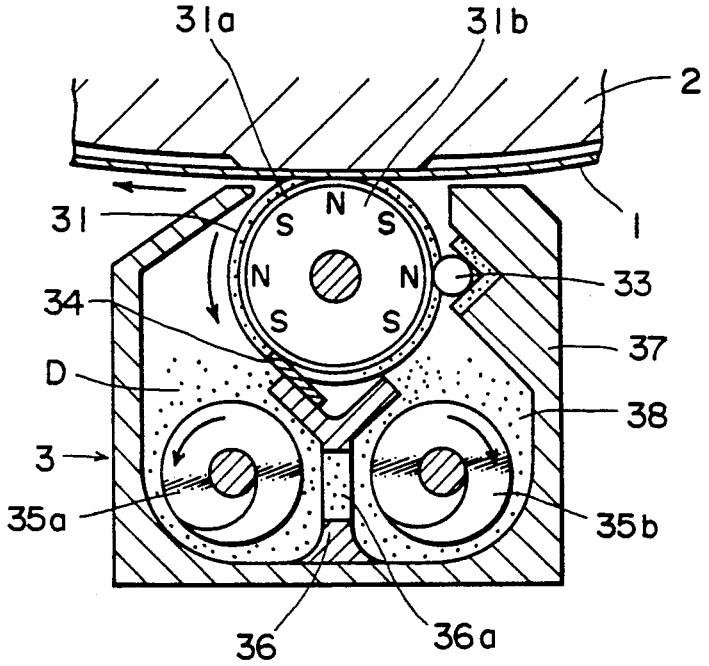
FIG. 1(*a*) is a sectional front view of an embodiment of a developing apparatus according to the present invention.
Figure 1B:
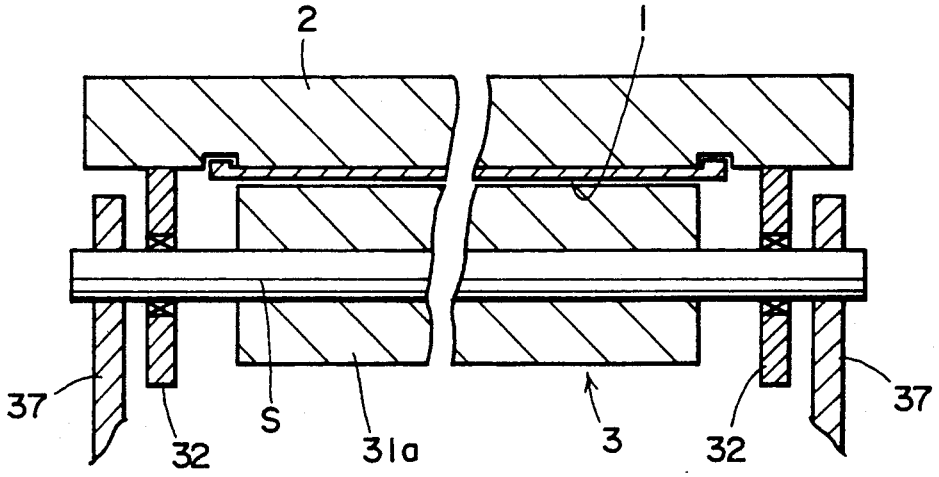

In FIGS. 1(*a*), 1(*b*), and 2(*a*), reference numeral 1 denotes a photosensitive belt (belt-shaped image retainer), 2 denotes a guide member which is brought into contact with an inner surface of the photosensitive belt 1 for regulating the belt position, 3 denotes a developing apparatus, 31 denotes a developing roll consisting of a developing sleeve 31*a* and a stationary magnet roll 31*b* disposed in said developing sleeve 31*a* and having a plurality of magnet members, 32 denotes abutting rollers, 33 denotes a developer layer thickness regulating member consisting of magnetic material having a rigidity, 34 denotes a scraper such as a hard rubber blade for removing developer, 35*a* and 35*b* denote agitating screws which are a pair of agitating members for agitating and circulating the developer in the opposite directions, 36 denotes a partition plate in the shape of a letter Y in cross section having a plurality of through holes 36*a* for developer, disposed between the agitating screws 35*a* and 35*b*, 37 denotes a case of the developing apparatus 3, and 38 denotes a developer reservoir formed on the bottom portion of the case 37. Reference symbol D denotes the developer and S denotes a rotary shaft of the developing sleeve.

The abutting rollers 32 are disposed at both sides of said developing sleeve 31*a* and supported rotatably by the rotary shaft S. Each of the abutting rollers 32 has an outer diameter a little larger than that of the developing sleeve 31*a* so that a gap corresponding to the developing distance of 0.2–1.0 mm can be formed between the peripheral surface of the developing sleeve 31*a* and the outer peripheral surface of the photosensitive member 1 as shown in FIG. 1(*b*), when said abutting rollers 32 are brought into press contact with said guide member 2.

An operation of the developing apparatus in case that the developer D consists of toner and magnetic carrier will be explained.

The agitating screws 35*a*, 35*b* are used as feeding members and rotated in the opposite directions, respectively, and accordingly the developer D fed in one direction by the propelling force of the agitating screw 35*a* moves to the side of the agitating screw 35*b* and fed in the opposite direction by the propelling force of the agitating screw 35*b*.

On the way of feed of the developer D, a small quantity of the developer transfers to the opposite feeding path continuously, thereby preventing the developer from being biased to one side and enhancing the agitation and the mixture of the developer. In this embodiment, the through holes 36*a* are provided on a vertical portion of the partition plate 36, so that a part of the developer D is passed from one side through the through holes 36*a* into the other side and that the toner and carrier are agitated fully of course, the through holes 36*a* may be formed only on both ends of the partition plate 36. In this embodiment, the through holes 36*a* are formed on both ends and an intermediate portion of the partition plate 36, so that the bias of the developer layer can be prevented. The homogeneous developer D frictionally charged by the function of the mixing of the toner with carrier is attached as a layer on the peripheral surface of the developing sleeve 31*a* by the function of the agitating screw 35*b* and the magnet roll 31*b* arranged inside of the developing sleeve 31*a*. The layer thickness of the developer D attached on the peripheral surface of the developing sleeve 31*a* is reduced when the developer layer is passed through a layer thickness regulating member (not shown) made of hard magnetic material and brought into press contact with the developing sleeve 31*a* under a predetermined load. A latent image on the peripheral surface of the photosensitive belt 1 is developed with the developer in the non-contact manner at the developing region to form a toner image.

At the time of the non-contact developing a developing bias voltage having a DC current component and an AC current component is applied from a power source (not shown) to said developing sleeve 31*a*, so that only the developer D on the developing sleeve 31*a* is selectively moved and attached to the latent image surface to form the toner image.

Figure 3:
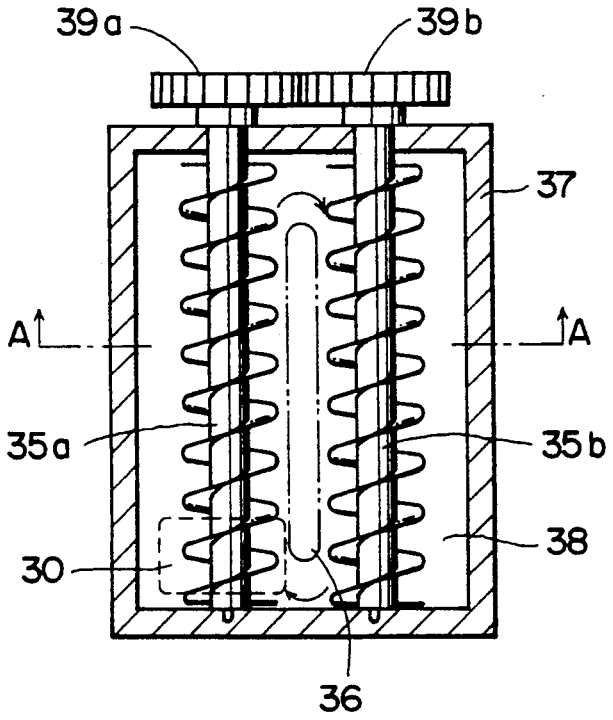
FIG. 3(*a*) is a plan view of a reservoir portion of the developing apparatus.
Figure 3:
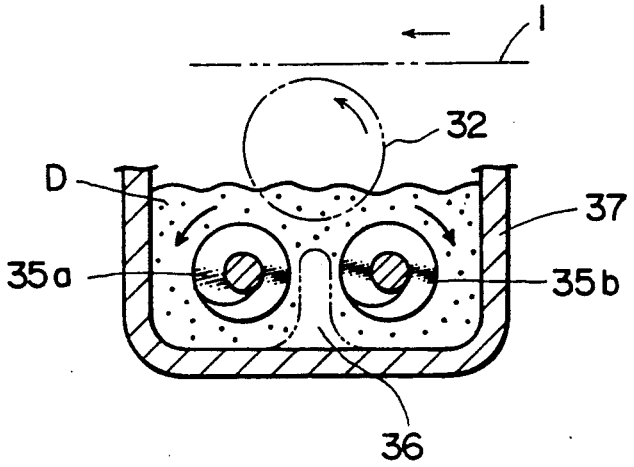

The developer D, of which toner has been consumed by the development and reduced in percentage of toner content is fed by the developing sleeve 31*a*, scraped by the scraper 34 which has been brought into contact with the developing sleeve 31*a*, and recovered. The recovered developer is mixed with a developer D of higher percentage of toner content and agitated, so that it is charged frictionally and homogenized. The thus obtained developer is fed to the developing sleeve 31*a* after it is agitated by the screws 35*a* and 35*b* as shown in FIGS. 3(*a*) and 3(*b*).

Said partition plate 36 is in the shape of a letter Y with the scraper 34 fixed to one side of the upper portion of the partition plate 36 by adhesive agents etc., so that a height from the top of the scraper 34 to the bottom of the developing device 3 can be reduced. It is, of course, possible to form the partition plate 36 and the scraper 34 as one body.

Figure 2A:
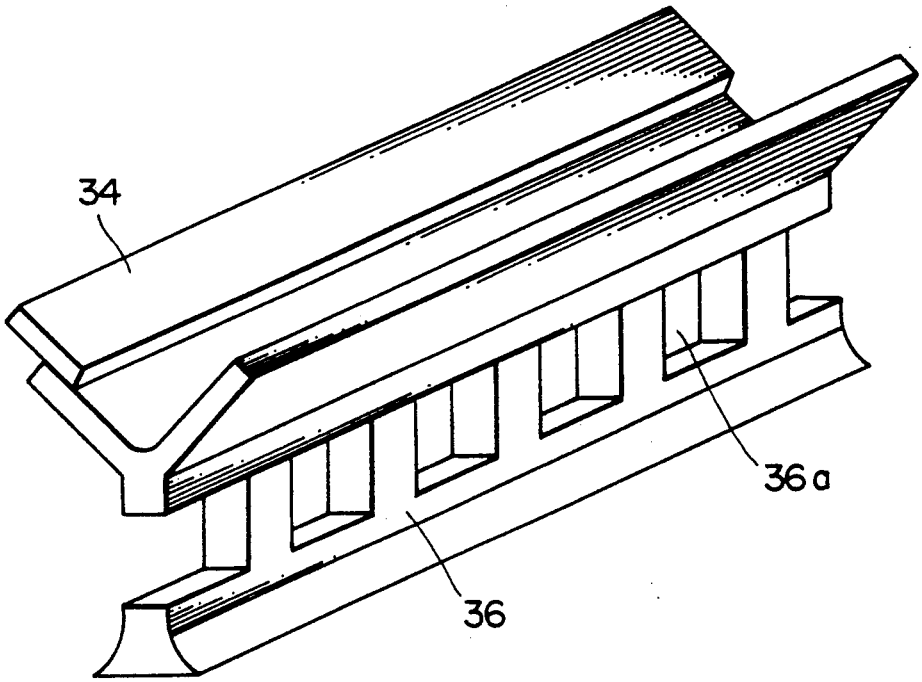
FIG. 2(*a*) is a perspective view of a partition plate shown in FIG. 1(*a*)
Figure 2B:
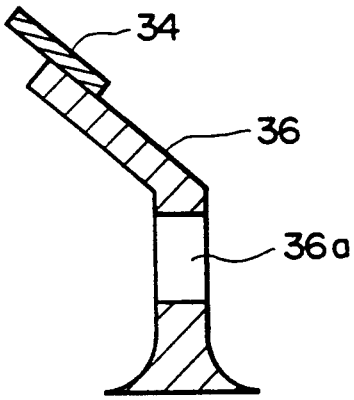

The same effect can be obtained by such a construction that an upper portion of the vertical partition plate 36 is inclined and the scraper 34 is mounted to said inclined portion as shown in FIG. 2(*b*).

According to the developing apparatus of the present invention, a torque required to rotate the developing sleeve 31*a* can be reduced compared with the conventional developing apparatus, because the partition plate 36 is provided and no magnetic pole is positioned on a portion of the magnet roll 31*b* between two nagnetic poles and above said partition plate 36 as shown in FIG. 1(*a*) so that the developer D is not attached to the developing sleeve 31*a* and the rotation of the developing sleeve 31*a* is hardly prevented.

The above explanation is for the belt-shaped image retainer, however, the same effect can be obtained in case of the drum-shaped image retainer.

According to the present invention, as has been described hereinbefore, the developing apparatus can be made compact, because the developer removing means is held firmly by the partition plate and the height from the top of the developer removing means to the bottom of the developing device is reduced. Further, the agitation and the mixture of the developer can be carried out effectively, because the through holes for the developer are provided in the partition plate. Accordingly, the developing apparatus which can develop the latent image effectively and is made compact can be provided.

What is claimed is:

1. An apparatus for developing an electrostatic latent image on an image retainer with a developer by supplying said developer to said image retainer in a downstream direction, said apparatus comprising a developing roll facing said image retainer comprising fixed magnetic poles arranged so as not to be in a position facing said partition, a first agitating member and a second agitating member disposed below said developing roll, a partition between said first member and said second member, a developer remover on an upper portion of said partition for removing said developer from said developing roll, a developer delivery portion upstream of said first agitating member, said first agitating member receiving said developer from said delivery portion and removed developer from said remover, said developer agiatated by said first member is carried to and agitated by said second member, and said developer agitated by said second member is carried to said developing roll.

2. The apparatus of claim 1 wherein said partition has a hole between said first member and said second member.

3. The apparatus of claim 1 wherein said developer remover is a rubber blade.

4. An apparatus for developing an electrostatic latent image on an image retainer with a developer by supplying said developer to said image retainer in a downstream direction, said apparatus comprising a developing roll facing said image retainer, a first agitating member and a second agitating member disposed below said developing roll, a partition between said first member and said second member, said partition having a Y-shaped cross section and comprising a first edge portion and a second edge portion, a developer remover being mounted on said first edge portion for removing said developer from said developing roll, a developer delivery portion upstream of said first agitating member, said first agitating member receiving said developer from said delivery portion and removed developer from said remover, said developer agitated by said first member is carried to and agiatated by said second member, and said developer agitated by said second member is carried to said developing roll.

5. The apparatus of claim 1 wherein said developing roll comprises fixed magnetic poles arranged so as not to be in the position facing said partition.

6. The apparatus of claim 4 wherein said partition has a hole between said first member and said second member.

7. The apparatus of claim 4 wherein said developer remover is a rubber blade.

8. An apparatus for developing an electrostatic latent image on an image retainer with a developer by supplying said developer to said image retainer in a downstream direction, said apparatus comprising a developing roll facing said image retainer, said developing roll having magnets so positioned that no magnetic pole faces a portion between said first edge and said second edge, a first agitating member and said second agitating member disposed below said developing roll, a partition between said first member and said second member, said partition comprising a first edge portion and a second edge said developer remover being mounted on said first edge, portion for removing said developer from said developing roll, a developer delivery portion upstream of said first agitating member, said first agitating member receiving said developer from said delivery portion and removed developer from said remover, said developer agitated by said first member is carried to an agitated by said second member, and said developer agaitated by said second member is carried to said developing roll.

9. The apparatus of claim 8 wherein said partition has a hole between said first member and said second member.

10. The apparatus of claim 8 wherein said developer remover is a rubber blade.

* * * * *